United States Patent [19]

Kauffman et al.

[11] 4,258,085

[45] * Mar. 24, 1981

[54] PROCESS OF FORMING AN EMBOSSED SURFACE COVERING

[75] Inventors: William J. Kauffman, Lancaster; George L. Lilley, Manheim, both of Pa.

[73] Assignee: Armstrong Cork Company, Lancaster, Pa.

[ * ] Notice: The portion of the term of this patent subsequent to Apr. 15, 1997, has been disclaimed.

[21] Appl. No.: 869,683

[22] Filed: Jan. 16, 1978

[51] Int. Cl.[2] ..... B05D 3/02; B05D 5/00

[52] U.S. Cl. ..... 427/244; 427/264; 427/340; 427/341; 427/342; 427/370; 427/373

[58] Field of Search ..... 427/244, 264, 342, 373, 427/270, 275, 276, 340, 341, 370; 264/DIG. 18, DIG. 82, 48; 428/159–160

[56] References Cited

U.S. PATENT DOCUMENTS

| | | | |
|---|---|---|---|
| 2,961,332 | 11/1960 | Nairn | 427/264 |
| 3,293,094 | 12/1966 | Nairn et al. | 156/79 |
| 3,454,413 | 7/1969 | Miller | 427/224 |
| 3,574,659 | 4/1971 | Kwart et al. | 427/258 |
| 3,607,341 | 9/1971 | Goins et al. | 427/373 X |
| 3,943,018 | 3/1976 | Petry et al. | 156/79 |
| 3,956,530 | 5/1976 | McKee, Jr. et al. | 427/198 X |
| 3,958,043 | 5/1976 | McKee, Jr. et al. | 427/342 X |
| 3,958,054 | 5/1976 | McKee, Jr. et al. | 427/342 X |

*Primary Examiner*—Evan K. Lawrence

*Attorney, Agent, or Firm*—Dennis M. Kozak

[57] ABSTRACT

A process of forming an embossed surface covering is disclosed. The process comprises forming a crosslinkable foam on a backing, depositing an activator composition to initiate cross-linking on at least a portion of the crosslinkable foam, and heating the resulting crosslinkable foam-containing sheet to a temperature sufficient to crosslink the portions of the foam affected by the deposition of activator composition and melt the portions of the foam not affected by the deposition of activator composition.

8 Claims, 2 Drawing Figures

PROCESS OF FORMING AN EMBOSSED SURFACE COVERING

BACKGROUND OF THE INVENTION

This invention relates to decorative surface coverings.

More specifically, this invention relates to embossed floor and wall coverings.

In one of its more specific aspects, this invention relates to a process of forming embossed floor and wall coverings.

The need for methods for the production of decorative effects on floor coverings, wall coverings, and the like is well known.

The present invention provides a process which facilitates the formation of an embossed decorative effect on surface coverings.

SUMMARY OF THE INVENTION

According to this invention, there is provided a process of forming an embossed surface covering comprising forming a crosslinkable foam on a backing, depositing an activator composition to initiate cross-linking on at least a portion of the crosslinkable foam and heating the resulting crosslinkable foam-containing sheet to a temperature sufficient to crosslink the portions of the foam affected by the deposition of activator composition and melt the portions of the foam not affected by the deposition of activator composition.

BRIEF DESCRIPTION OF THE DRAWINGS

The present invention will be more easily understood by referring to the following drawings in which.

DETAILED DESCRIPTION OF THE INVENTION

Figure 2:
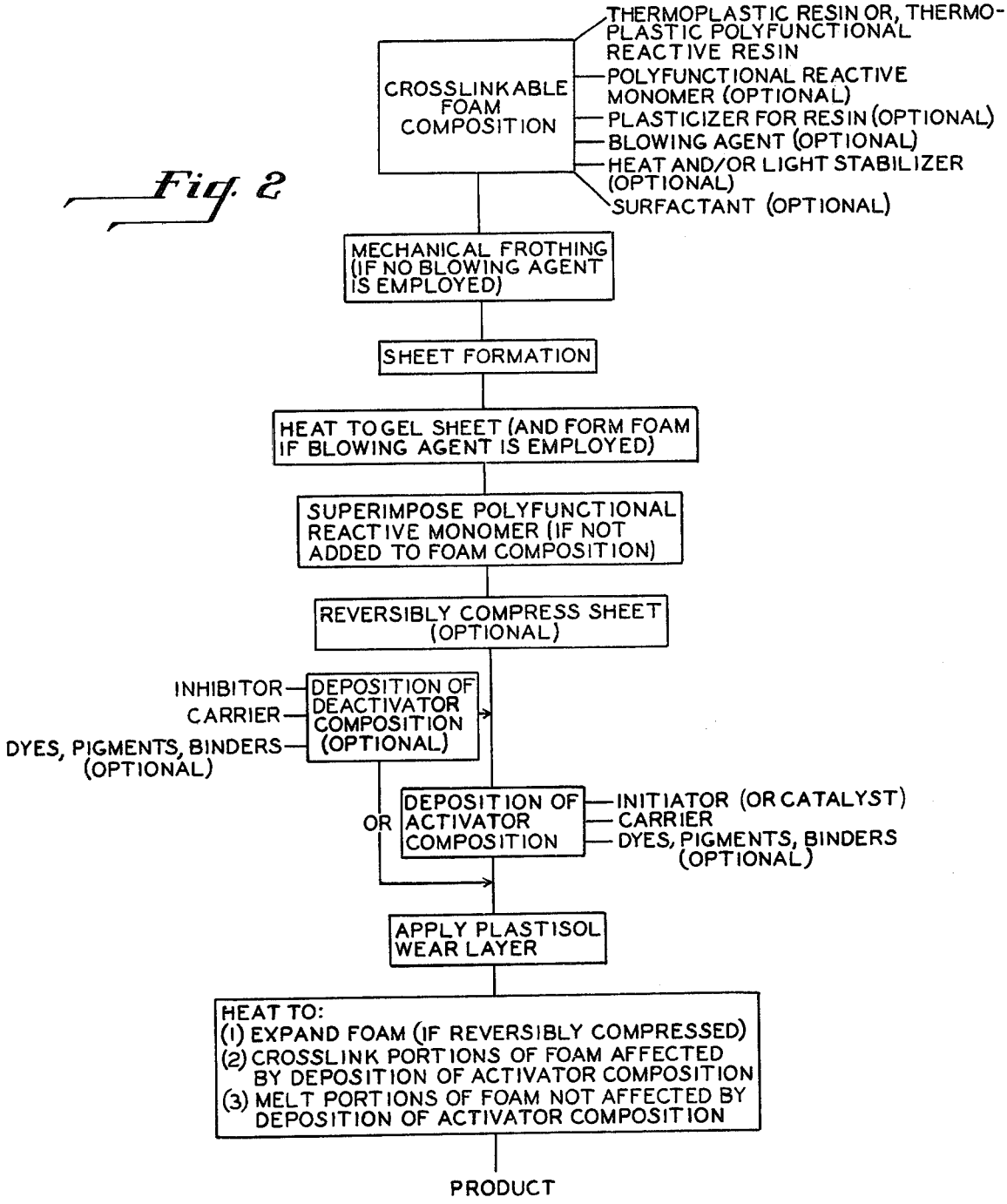
FIG. 2 is a flow diagram illustrating the process and various embodiments of the present invention.

As used herein, the term "crosslinkable foam" is understood to mean (1) a foam formed from a composition comprising at least one thermoplastic resin homopolymer, copolymer, polymer blend or polymer mixture and a polyfunctional reactive monomer which will crosslink or (2) a foam formed from a composition comprising at least one thermoplastic polyfunctional reactive resin which contains sufficient functionality to crosslink.

If the foam contains a polyfunctional reactive monomer as set forth in (1) above, it is further understood that the polyfunctional reactive monomer can be incorporated into the foam by either superimposing the monomer over the foam surface and allowing the monomer to migrate into the foam or by incorporating the monomer directly into the foam composition prior to foaming the composition.

As used herein, the term "crosslink" is understood to mean an effective increase in the molecular weight, up to and including the point of insolubility, of a crosslinkable foam, which increase in molecular weight affects the melt rheology of the crosslinkable foam by increasing its melt viscosity.

As used herein, the term "activator composition" is understood to mean a composition which facilitates crosslinking of the crosslinkable foam.

In one embodiment of this invention, the crosslinkable foam is formed by the mechanical incorporation of air (frothed) into the cross-linkable foam composition. The resulting mechanically-produced cross-linkable foam is then deposited on a backing.

In another embodiment, the crosslinkable foam is produced by incorporating a blowing agent into the crosslinkable foam composition, depositing the composition on a backing and heating the composition to decompose the blowing agent, evolve a gas, and thus form a cellular structure.

In another embodiment, the crosslinkable foam-containing sheet is reversibly compressed prior to the deposition of the activator by heating the sheet to a temperature within the range of from about 200° to about 500° F. and simultaneously compressing and cooling the sheet in a laminator at a temperature within the range of from about 150° to about 300° F.

In yet another embodiment, a deactivator composition is superimposed over at least a portion of the activator composition in order to counteract the effect of the activator composition. Alternatively, the deactivator composition can be deposited on portions of the crosslinkable foam surface prior to the deposition of the activator composition in order to counteract the effect of the activator composition.

As used herein, the term "deactivator composition" is understood to mean a composition which either stops, retards or alters crosslinking of the crosslinkable foam.

The crosslinkable foam composition of this invention will contain at least one thermoplastic resin or thermoplastic polyfunctional reactive resin. The only limitation in the selection of the resin is that it be foamable.

Thermoplastic resins particularly suitable for use include poly(vinyl chloride) resins, acrylic resins, vinyl acetate resins, vinyl chloride-vinyl acetate copolymers, and the like.

Thermoplastic polyfunctional reactive resins suitable for use include blocked copolymers of styrene and butadiene, maleic acid polyesters, and the like.

The crosslinkable foam composition (if a thermoplastic resin is employed) can contain from about 8 to about 100 parts per 100 parts of resin of a polyfunctional reactive monomer, preferably from about 10 to about 30 parts per 100 parts of resin of the monomer.

Any suitable polyfunctional reactive monomer can be employed. Suitable monomers include polyfunctional melamine-formaldehyde resins, polyfunctional urea-formaldehyde resins, and polyfunctional olefins, for example, polyfunctional methylmethacrylate esters.

A particularly suitable monomer is trimethylolpropane-trimethacrylate.

If, as described above, the polyfunctional reactive monomer is superimposed on the crosslinkable foam surface rather than incorporated into the crosslinkable foam composition, the polyfunctional reactive monomer will still be employed in an amount of from about 8 to about 100 parts per 100 parts of resin, preferably from about 10 to about 30 parts per 100 parts of resin.

If the crosslinkable foam composition contains a blowing agent, the blowing agent will be employed in an amount within the range of from about 0.5 to about 10 parts per 100 parts of resin.

Any suitable blowing agent can be employed. A particularly suitable blowing agent is azodicarbonamide.

Optionally, the crosslinkable foam compositions can also contain a plasticizer for the resin, a head and/or light stabilizer, a surfactant, and the like.

In its preferred form, the crosslinkable foam composition will contain at least one plasticizer in a total amount up to about 100 parts, preferably about 40 to about 60 parts, per 100 parts of resin.

Any suitable plasticizer can be employed. A particularly suitable plasticizer is dioctyl phthalate.

In its preferred form, the crosslinkable foam composition will contain at least one heat and/or light stabilizer in a total amount up to about 5 parts, preferably about 1 to about 3 parts, per 100 parts of resin.

Any suitable heat and/or light stabilizer can be employed. Suitable stabilizers are organo tin compounds. A particularly suitable organo tin compound [dibutyl tin bis(alkyl maleate)] is designated "Mark 275", commercially available from Argus Chemical Company.

In its preferred form, the crosslinkable foam composition will contain at least one surfactant in a total amount up to about 10 parts, preferably 1 to 8 parts, per 100 parts of resin.

Any suitable surfactant can be employed. Particularly suitable for use are two resinous dimethyl silicates designated "Dow-Corning 1250 Silicone Surfactant" and "Dow-Corning 1252 Silicone Surfactant," both commerically available from Dow-Corning Corporation.

The activator composition of this invention will contain an initiator (or catalyst) in an amount within the range of from about 5 to about 50 percent by weight of the composition. In its preferred form, the activator composition will contain from about 7 to about 20 percent by weight of the composition of the initiator.

Initiators are well known in the art and are understood to include free radical generators and acid catalysts.

Any suitable initiator can be employed. Particularly suitable initiators include the organic peroxides, especially benzoyl peroxide, oxalic acid, sulfonic acid, and the like.

The activator composition will contain a carrier for the initiator in an amount within the range of from about 50 to about 95 percent by weight of the activator composition. In its preferred form, the activator composition will contain from about 80 to about 93 percent by weight of the composition of the carrier.

The carrier can be any suitable material which serves as a solvating material for the foam. Suitable carriers include methyl isobutyl ketone, cyclohexanone, and the like.

The activator composition can also be formulated to include various well known dyes, pigments and binders, such that the activator functions as an ink composition and serves to make a design on the foam on which it is deposited.

The deactivator composition of this invention will comprise an inhibitor in an amount within the range of from about 5 to about 50 percent by weight of the composition. In its preferred form, the deactivator composition will contain from about 7 to about 20 percent by weight of the composition of inhibitor.

Any suitable inhibitor can be employed. Particularly suitable inhibitors include hydroquinone, toluquinone, the monomethyl ether of hydroquinone, and the like. Additionally, as known in the art, oxygen and bases such as sodium hydroxide can be employed as inhibitors.

The deactivator composition will contain a carrier for the inhibitor in an amount within the range of from about 50 to about 95 percent by weight of the deactivator composition. In its preferred form, the deactivator composition will contain from about 80 to about 93 percent by weight of the composition of the carrier.

Optionally, the deactivator composition can also be formulated to include various well known dyes, pigments and binders such that the deactivator composition also functions as an ink composition.

To prepare an embossed surface covering according to this invention, a crosslinkable foam as described above is applied to any desired thickness to any backing normally used in the industry using any conventional method of application, for example, a blade over roll applicator.

Next, the process takes one of two alternatives relating to whether the crosslinkable foam is produced mechanically or by incorporation of a blowing agent.

In the first alternative, if the crosslinkable foam is produced mechanically, the crosslinkable foam-containing sheet is subjected to heat in a conventional manner at a temperature within the range of from about 200° to about 400° F. for a period of from about 15 seconds to about 20 minutes in order to gel the foam-containing sheet.

In the second alternative, if the crosslinkable foam is produced by the incorporation of a blowing agent, the crosslinkable foam-containing sheet is subjected to heat in a conventional manner at a temperature and for a period of time sufficient to decompose the blowing agent thus forming a gelled foam-containing sheet.

At this point, if the polyfunctional reactive monomer has not been incorporated into the crosslinkable foam composition or a thermoplastic polyfunctional reactive resin is not employed, the polyfunctional reactive monomer is applied to the foam surface using any conventional method of application, for example, reverse roll coating, and allowed to migrate into the foam to produce a crosslinkable foam before proceeding.

If desired, in order to facilitate processing, the crosslinkable foam on the sheet can be reversibly compressed to a higher density by heating the sheet to a temperature within the range of from about 200° to about 500° F. and then compressing and cooling the sheet by passing it through a laminator, for example, a smooth, steel laminator equipped with a water circulating cooling system, such that the compressed sheet exiting the laminator has a temperature within the range of from about 150° to about 300° F.

The activator composition is then deposited on at least a portion of the surface of the crosslinkable foam using any conventional method of deposition, the amount deposited on the foam surface depending on the particular method of deposition. For example, if rotogravure printing is selected as the method of deposition, a very small amount of the composition will be deposited as compared to screen or block printing.

The only limitation regarding the method of deposition of the activator composition is that the method must suffice to deposit a sufficient amount of composition on the foam surface to initiate cross-linking in the portion of the foam affected by the deposition of activator composition.

In one embodiment, either before or after depositing the activator composition, and employing the same methods of employment described above, a deactivator composition is deposited on a portion of the crosslinkable foam surface or, alternatively, superimposed over a portion of the activator composition. The deactivator composition serves to stop or alter the reaction between the activator composition and the polyfunctional reactive monomer. The amount of deactivator composition deposited must be sufficient to either significantly or completely counteract the affect of the activator composition.

After depositing the activator composition (or the deactivator composition), a final clear coat can be applied over the entire sheet or a portion thereof to serve as a wear-resistant layer. These clear coats are well known in the art and typically comprise poly(vinyl chloride) plastisols. The final clear coat thickness may be in the range of from about 1 to about 20 mils and is applied by conventional and well known methods.

The resulting sheet is then subjected to heat in a conventional manner at a temperature within the range of from about 200° to about 500° F. in order to: (1) cause the crosslinkable foam, if reversibly compressed, to expand substantially to its original foam height, (2) cause the portions of the foam affected by the deposition of activator composition to crosslink, and (3) cause the portions of the foam not affected by the deposition of activator composition, that is, the portions in which no activator composition has been deposited or the portions in which both activator composition and deactivator composition have been deposited, to melt.

Upon cooling, the resulting product is recoverable as an embossed surface covering.

Figure 1:
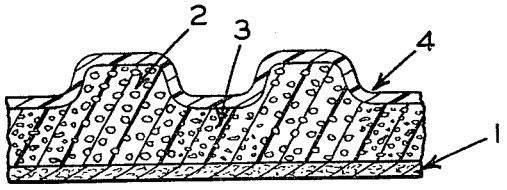
FIG. 1 is an enlarged, simplified, cross-sectional view of an embossed surface covering of this invention, having a clear coat as a wear-resistant layer.

Referring now to FIG. 1, the embossed surface covering comprises a raised, cellular, crosslinked portion 2 and melted portion 3 on backing 1. Clear coat 4 serves as a wear-resistant layer for the embossed surface covering. FIG. 2 is a flow diagram illustrating the process and various embodiments of the present invention.

Having described the ingredients and methods of the invention, reference is now made to the following examples which are provided by way of illustration and not limitation of the practices of the invention.

EXAMPLE I

This example demonstrates the best mode for producing an embossed surface covering of this invention.

To an Oakes foamer were added and mechanically foamed about 100 parts of a thermoplastic resin blend comprising about 65 parts of poly(vinyl chloride) resin homopolymer and about 35 parts of poly(vinyl chloride) resin copolymer, about 70 parts per 100 parts of the resin blend of a plasticizer (dioctyl phthalate), about 20 parts per 100 parts of the resin blend of a polyfunctional reactive monomer (trimetholpropane-trimethacrylate), about 2 parts per 100 parts of the resin blend of an organo tin stabilizer ("Mark 275"), and about 4 parts per 100 parts of the resin blend of a silicone surfactant ("Dow-Corning 1252 Silicone Surfactant").

The resulting crosslinkable foam was recovered and applied to a gelled plastisol coated release paper using a blade over roll applicator.

The resulting crosslinkable foam-containing sheet was heated for about 10 minutes at a temperature of about 275° F. to gel the foam. The resulting gelled foam was tested and found to have a foam density of about 24 lbs./ft.$^3$ and a thickness of about 0.06 inch.

The resulting sheet, immediately after gelling the foam, at a temperature of about 275° F. was reversibly compressed using a smooth, steel roll laminator and simultaneously cooled to a temperature of about 170° F. After compression, the foam was tested and found to have a density of about 55 lbs./ft.$^3$ and a thickness of about 0.026 inch.

To a mixing vessel at room temperature and with stirring were added about 10 percent by weight of an initiator (benzoyl peroxide), about 63 percent by weight of a carrier (methyl isobutyl ketone), about 6 percent by weight of a pigment, and about 21 percent by weight of a binder.

The contents of the mixing vessel were recovered as an activator/ink composition and selectively rotogravure printed on portions of the foam surface of the above compressed sheet. The printing characteristics of the printed sheet were observed to be excellent.

The printed sheet was clear coated with about a 4 mil film of a poly(vinyl chloride) plastisol wear layer.

The resulting sheet was placed in an oven at about 380° F. for a period of about 2 minutes.

The resulting product was cooled to room temperature, recovered as an embossed floor covering, tested and found to have surface depressions corresponding to about a 20 mil embossed decorative effect.

EXAMPLE II

This example demonstrates the employment of an activator composition in combination with a deactivator composition to produce an embossed surface covering of this invention.

The same methods and ingredients employed in Example I were employed with the exception that rather than selectively rotogravure printing portions of the foam surface, the entire foam surface was rotogravure printed with the activator composition and additionally a deactivator composition was prepared by adding to a mixing vessel at room temperature and with stirring about 12 percent by weight of an inhibitor (hydroquinone), about 61 percent by weight of a carrier (methyl isobutyl ketone), about 6 percent by weight of a pigment, and about 21 percent by weight of a binder.

The resulting deactivator composition was selectively rotogravure printed over regions of the activator composition printed portions of the foam surface.

The resulting product was again recovered as an embossed floor covering, tested and found to have surface depressions corresponding to about a 20 mil embossed decorative effect.

It will be evident from the foregoing that various modifications can be made to the present invention. Such, however, are considered as being within the scope of the invention.

What is claimed is:

1. A process of forming an embossed surface covering comprising forming a cross-linkable foam on a backing, the cross-linkable foam comprising:

(a) at least one thermoplastic resin homopolymer, copolymer, polymer blend, or polymer mixture and a polyfunctional reactive monomer which will cross-link upon contact with an activator composition or (b) at least one thermoplastic polyfunctional resin which contains sufficient functionality to cross-link upon contact with an activator composition;

depositing an activator composition comprising an initiator and a carrier on at least a portion of the cross-linkable foam surface in an amount sufficient to initiate cross-linking in the portions of the cross-linkable foam affected by the deposition of the activator composition upon the subsequent application of heat; and heating the resulting cross-linkable foam-containing sheet to a temperature sufficient to corss-link the portions of the foam affected by the deposition of activator composition and melt the portions of the foam not affected by the deposition of activator composition, thereby producing an embossed surface having raised, cellular, cross-linked portions and lower melted portions of higher density than the raised portions.

2. The process of claim 1 in which said polyfunctional reactive monomer is incorporated into said crosslinkable foam by superimposing said monomer over the foam surface and allowing said monomer to migrate into said crosslinkable foam.

3. The process of claim 1 in which said polyfunctional reactive monomer is incorporated into said crosslinkable foam composition by incorporating said monomer into the crosslinkable foam composition prior to foaming said composition.

4. The process of claim 1 in which said crosslinkable foam is formed by the mechanical incorporation of air into the crosslinkable foam composition.

5. The process of claim 1 in which said crosslinkable foam is formed by the incorporation of a blowing agent into the crosslinkable foam composition.

6. The process of claim 1 in which said crosslinkable foam-containing sheet is reversibly compressed prior to the deposition of said activator composition.

7. The process of claim 1 in which a deactivator composition, which serves to stop, retard, or alter cross-linking, is superimposed over at least a portion of the activator composition applied portion of the cross-linkable foam.

8. The process of claim 1 in which a deactivator composition is deposited on a portion of the foam surface prior to the deposition of the activator composition, said deactivator composition serving to stop, retard, or alter cross-linking in at least a portion of the activator composition applied portion of said cross-linkable foam.

* * * * *